US012044034B2

(12) United States Patent
Jiang et al.

(10) Patent No.: US 12,044,034 B2
(45) Date of Patent: Jul. 23, 2024

(54) FUNCTION-RECOVERABLE PREFABRICATED SEISMIC SHEAR WALL STRUCTURE

(71) Applicant: Tongji University, Shanghai (CN)

(72) Inventors: Huanjun Jiang, Shanghai (CN); Haozuo Wang, Shanghai (CN); Liusheng He, Shanghai (CN)

(73) Assignee: Tongji University, Shanghai (CN)

( * ) Notice: Subject to any disclaimer, the term of this patent is extended or adjusted under 35 U.S.C. 154(b) by 2 days.

(21) Appl. No.: 17/830,241

(22) Filed: Jun. 1, 2022

(65) Prior Publication Data

US 2022/0389708 A1 Dec. 8, 2022

(30) Foreign Application Priority Data

Jun. 2, 2021 (CN) ..... 202110615899.8

(51) Int. Cl.
*E04H 9/02* (2006.01)
*E04B 1/04* (2006.01)
(Continued)

(52) U.S. Cl.
CPC ..... *E04H 9/021* (2013.01); *E04B 1/04* (2013.01); *E04B 1/98* (2013.01); *E04B 2/58* (2013.01);
(Continued)

(58) Field of Classification Search
CPC ..... E04B 1/04; E04B 1/98; E04B 2/58; E04B 5/38; E04B 5/165; E04C 3/293; E04H 9/021; E04H 9/0215; E04H 9/027
See application file for complete search history.

(56) References Cited

U.S. PATENT DOCUMENTS 4,350,233 A * 9/1982 Buckley ..... E04H 9/0215 267/140.11
4,881,350 A * 11/1989 Wu ..... E04H 9/023 248/580
(Continued)

FOREIGN PATENT DOCUMENTS

CN 109267675 A * 1/2019 ..... E04B 2/56
JP 2019078130 A * 5/2019
WO WO-2004013428 A1 * 2/2004 ..... E04H 9/021

*Primary Examiner* — Jessie T Fonseca

(57) ABSTRACT

A novel function-recoverable prefabricated seismic shear wall structure with replaceable components, which includes main structural components, connecting components and replaceable components. All components are connected by bolts or pins. The connections can provide sufficient strength to effectively connect adjacent upper and lower wall panels, or wall panel and coupling beam, together. The replaceable components are installed in the bottom region of the wall and coupling beams, which provide sufficient bearing capacity and stiffness for the building structure under service loads and dissipate seismic energy under the earthquake. The damage concentrates on the replaceable components which could be easily replaced after a strong earthquake so that the function of the building structure could be quickly restored. In addition, the replaceable components with different energy-dissipation mechanisms facilitate the shear wall structure to have multiple seismic fortification lines, and improve the seismic performance of the building structure.

10 Claims, 7 Drawing Sheets

(51) Int. Cl.

| | |
|---|---|
| ***E04B 1/98*** | (2006.01) |
| ***E04B 2/58*** | (2006.01) |
| ***E04B 5/38*** | (2006.01) |
| ***E04C 3/293*** | (2006.01) |
| ***E04C 5/16*** | (2006.01) |

(52) U.S. Cl.
CPC ..... *E04B 5/38* (2013.01); *E04C 3/293* (2013.01); *E04C 5/165* (2013.01); *E04H 9/0215* (2020.05); *E04H 9/027* (2013.01)

(56) References Cited

U.S. PATENT DOCUMENTS 5,732,802 A * 3/1998 Tsukagoshi ..... E04H 9/0237 267/136
6,550,200 B1 * 4/2003 Mueller ..... E04B 1/26 52/698
6,840,017 B1 * 1/2005 Shimoda ..... E04H 9/0215 52/167.7
2003/0051433 A1 * 3/2003 Koo ..... E04C 3/294 52/630
2005/0257451 A1 * 11/2005 Pryor ..... E04B 1/98 52/167.4
2005/0274084 A1 * 12/2005 Lin ..... E01D 19/00 52/167.1
2006/0000167 A1 * 1/2006 Nakaki ..... E04H 9/021 52/292
2013/0174501 A1 * 7/2013 Michael ..... F16F 7/09 52/167.1
2015/0322923 A1 * 11/2015 Könitz ..... E04H 12/08 188/380
2017/0268252 A1 * 9/2017 Gray ..... E04H 9/021
2018/0266135 A1 * 9/2018 Agha Beigi ..... E02D 27/34
2019/0376306 A1 * 12/2019 Hejazi ..... E04H 9/0237
2021/0032858 A1 * 2/2021 Beyreuther ..... E04B 1/98
2021/0310267 A1 * 10/2021 Espinosa ..... E04H 9/14

* cited by examiner (a) Stereogram (b) Front view (c) Side view (a) Appearance (b) Internal construction (a) Stereogram (b) Floor slab-slab connection (c) Floor slab-wall panel connection (d) Flexible connection

FUNCTION-RECOVERABLE PREFABRICATED SEISMIC SHEAR WALL STRUCTURE

CROSS REFERENCE TO RELATED PATENT APPLICATION

The application claims the priority of the Chinese patent application No. 202110615899.8 filed on Jun. 2, 2021, which is incorporated herein by reference.

FIELD OF THE INVENTION

The present disclosure relates to the field of function recoverable structures.

TECHNICAL BACKGROUND

The function recoverable structure with replaceable components is a new type of function-recoverable structure developed in recent years, which can restore the structural function immediately after a severe earthquake without significant repair. The concept of the structure with replaceable components is to design the parts of structure that tend to be damaged under the earthquake acting as the replaceable energy-dissipation components. The damage to the structure during the earthquake will concentrate on these components, which can be easily replaced after the earthquake so that the function of the structure can be quickly restored.

The shear wall is one of the main lateral force-resistance members of high-rise building structures widely used in seismic zones around the world. The conventional shear wall was found from past earthquake experience to suffer severe damage. The damage is generally very difficult to repair, or the cost of repair is very high. To overcome these problems, the coupling beams and the two bottom corners of RC shear wall, which are vulnerable to severe damage, are designed as the replaceable energy-dissipation components. Installing replaceable components in the shear wall not only improves the deformability and energy-dissipation capacity of the structural wall but also restricts structural damage within replaceable component; besides, the function of the structure is quickly restored by replacing energy-dissipation components after the earthquake.

For the previously proposed shear walls with replaceable components, the rest of the wall except the replaceable parts are integral cast-in-place, which is considered as laborious, time consuming and often leads to substandard construction. On the other hand, the seismic energy is dissipated by the plastic deformation of the replaceable energy-dissipation components, and the residual deformation occurs in the shear wall due to the plastic deformation of the replaceable components, resulting in difficulties in replacing the components after the earthquake. In addition, the concrete located at the bottom of shear wall and close to the replaceable parts could be seriously crushed under strong earthquake. The damage to the non-replaceable cast-in-place part of the shear wall is not convenient to be repaired.

SUMMARY OF THE PRESENT DISCLOSURE

In order to overcome the drawbacks mentioned above, the present disclosure disclose a function-recoverable prefabricated seismic shear wall structure.

The technical solutions of the present disclosure are as follows:

A function-recoverable prefabricated seismic shear wall structure, which comprise: replaceable corner component, bottom connecting component, high-performance padding block, slotted steel plate, precast wall panel, wall connector, non-replaceable prefabricated coupling beam, replaceable coupling beam damper, prefabricated floor slab and foundation.

The design principle of the present disclosure is:

The present disclosure proposes the shear wall structure be divided into regular and easy-to-use factory prefabricated modular components. The integrated construction of the structure could be realized by dry connecting between various components.

Most of the current replaceable component shear wall has a single replaceable component (either replaceable coupling beam damper or replaceable wall foot), studies have showed that the bottom of the wall body is also possible to be damaged in the earthquake. The present disclosure disposes both the replaceable coupling beam damper and replaceable wall foot, furthermore, the present disclosure proposes to dispose a bottom connecting component, a high-performance padding block and a slotted steel plate in the foot of the replaceable component shear wall structure. Wherein, energy-consuming connection steel plate is set in the bottom connecting component to provide anti-pull and anti-shear capacity, high-performance padding block provides anti-compression and anti-shear capacity, and the slotted steel plate provides anti-shear capacity.

This structure can effectively ensure that the lateral stiffness and strength of the new shear wall are equivalent to or even better than the traditional cast-in-place shear wall, and when the bottom of the shear wall is serious damaged under strong earthquake, the energy-consuming connection steel plate, the high-performance padding block and the slotted steel plate can be replaced through relatively simple construction measures, so that the structure can restore to the original functional level after the earthquake.

Furthermore, by using replaceable components and non-replaceable components, the shear wall has multiple seismic mechanisms: the first one is the replaceable coupling beam, the second one is the replaceable wall foot, the third one is the bottom connecting component, the high-performance padding block, and the slotted steel plate, the fourth one is the non-replaceable components. And it increases the seismic performance of the shear wall.

The replaceable corner component comprises outer steel tubes, inner steel tubes, infilled grout, energy dissipation steel bar, disc springs, stop round steel plate, perforated round steel plates, connecting steel tubes and perforated end plate. The outer steel tubes and inner steel tubes are respectively welded on the bottom perforated end plate, and the infilled grout is filled between the outer and inner steel tube. Polytetrafluoroethylene material is coated on the inner wall of the outer steel tube and the outer wall of the inner steel tube to relieve the bonding between the steel tube and infilled grout.

The outer diameter of the perforated round steel plate equals to the inner diameter of the outer steel tube, and the diameter of the hole of the perforated round steel plate equals to the outer diameter of the inner steel tube. There are two perforated round steel plates, the upper one and the lower one. The lower perforated round steel plate is in contact with the top surface of the infilled grout and the upper perforated round steel plate is welded to the bottom of the connecting steel tube. The top of the connecting steel tube is welded to the top perforated end plate.

The disc springs are installed between the upper and lower perforated round steel plates and combined in series and parallel, the inner diameter of the disc spring is slightly larger than the outer diameter of the end of the energy dissipation steel bar.

The energy dissipation steel bar is set inside the inner steel tube, one end of it is welded to the perforated end plate and the other end of it is welded to the stop round steel plate. The bottom of the stop round steel plate is in contact with the top of the upper perforated round steel plate.

When the replaceable corner component is compressed, the disc springs are compressed along with the infilled grout, and energy dissipation steel bar is not involved due to separated gap between the stop round steel plate and the upper perforated round steel plate. The disc springs store the seismic energy through elastic deformation and convert the deformation energy into restoring force, which effectively reduces the residual deformation of the structure after the earthquake.

When the replaceable corner component is subjected to tension, the top of the component is lifted, the upper perforated round steel plate meets the stop round steel plate and the energy dissipation steel bar is stretched individually to dissipate seismic energy while the disc springs and infilled grout do not come into play.

The replaceable corner component has high bearing capacity, stiffness, energy-dissipating capacity, and self-centering capacity, which can significantly improve the seismic behavior of the shear wall.

The bottom connecting component comprises T-shaped steel beams, energy-consuming connection steel plate, high-strength pins, and high-strength bolts. Each bottom connecting component includes two T-shaped steel beams, the upper one is connected to the bottom of the precast wall panel and the lower one is embedded in the foundation.

The T-shaped steel beams is welded by a rectangular long steel plate, a perforated steel plate and stop steel plates. The perforated steel plate is vertical to the rectangular long steel plate. The stop steel sheets are disposed on both sides of the perforated steel plate.

The length and width of the rectangular long steel plate is consistent with the section dimensions of the precast wall panel, threaded holes are provided at both ends of the rectangular long steel plate in length direction for connecting the end plate of replaceable corner component. The length of the perforated steel plate is less than the rectangular long steel plate and the length of it is 0.6 to 0.8 times the length of the wall panel. The stop steel plate is a steel sheet with stiffeners. The stop steel plates are welded to both ends of the perforated steel plate and connect the high-performance padding block.

Furthermore, on the T-shaped steel beam which connected to the upper wall, some bolts are welded to both sides of the flange to connect with the slotted steel plate. The energy consuming connection steel plate is a steel plate with I-shaped cross-section. The upper and lower ends of the energy consuming connection steel plate are provided with holes, which can be connected to the upper and lower T-shaped steel beams by high-strength pins. The energy consumption connection plates can be coupled to the T-shaped steel beam by high-strength cylindrical pin.

The energy consumption connection plates are arranged on both sides of the perforated steel plate and the dimension and quantity of the energy consumption connection plate can be designed according to engineering requirements.

The high-performance padding block can be made of ultra-high toughness cementitious composites (UHTCC) concrete material. The block has two full-length holes along the length direction and is connected to T-shaped steel beams by screws. Compared with conventional concrete blocks of the same strength, the high-performance padding block is characterized by high toughness and ductile failure mode, and can still maintain high bearing capacity even after cracking. The high-performance padding block is suitable for the bottom part of the shear wall which is prone to cracking and collapse under the earthquake. Furthermore, the damaged high-performance padding block can be replaced after a strong earthquake.

The slotted steel plate is composed of slotted stressed steel plate, horizontal connecting steel plate and stiffener, which are welded into a whole. On each side of the wall base, two slotted steel plates are fastened to the foundation and the T-shaped steel beam by embedded high-strength bolts. On the one hand, the installation of slotted steel plate can compensate for the reduced lateral stiffness of the structure due to the setting of replaceable corner component. On the other hand, the vertical strips of the slotted stressed steel plate dissipate the seismic energy through plastic deformation under earthquakes to reduce the damage to the main structure. Furthermore, the damaged slotted steel plates can be replaced after the strong earthquake.

The precast wall panel is composed of longitudinal reinforcements, stirrups, concrete, perforated end plate, bolt sleeves, embedding steel plate and studs. The bolt sleeves are embedded in the wall panel and welded to the end of the longitudinal reinforcements. The bolt sleeves can be connected to the wall connector by bolts to form the bolt-wall connector-sleeve connection system, and then achieve the connection of upper and lower precast wall panels. For the precast wall panel arranged at the bottom of the structure, the lower end of the longitudinal reinforcements in the wall panel do not need to be set with bolt sleeves, and is welded directly to the T-shaped steel beam of the bottom connecting component in factory production. For the precast wall panel that needs to be connected to the non-replaceable prefabricated coupling beam, a connector is pre-embedded at the top of the wall panel, which includes perforated end plate, bolt sleeves, studs and embedding steel plate.

The wall connector is composed of a steel web and two perforated end plates. The steel web can be in the form of cross-shaped or I-shaped steel plate, which is welded to the perforated end plates. The perforated end plate is provided with threaded holes for bolting to the bolt sleeves in the precast wall panel.

The non-replaceable prefabricated coupling beam comprised longitudinal reinforcements, stirrups, concrete, perforated end plate, bolt sleeves, embedding steel plate, studs, and stiffened box-shape connector. The longitudinal reinforcements and embedding steel plate are arranged between perforated end plate and stiffened box-shape connector, and studs are assigned on the embedding steel plate to improve the bonding between steel plate and concrete. The bolt sleeves are welded to the perforated end plate, and the welding position is consistent with the position of the bolt holes on the perforated end plate for connection to the replaceable coupling beam damper. The stiffened box-shape connector is made of steel plates and stiffening rib plates, one side of the connector is welded to longitudinal reinforcements and embedding steel plate, and the other side is connected to the embedded connector in the precast wall panel.

The replaceable coupling beam damper is composed of energy-dissipation dampers and two perforated end plates. The energy-dissipation damper can be in various forms such as metal damper, viscoelastic damper, friction damper or hybrid damper. The energy-dissipation dampers are welded to the perforated end plates as the replaceable coupling beam damper, and are bolted to the non-replaceable prefabricated coupling beam.

The prefabricated floor slab is composed of precast bottom slab, cold-formed thin wall steel member, mesh reinforcement and post-cast concrete. The precast bottom slab can be composite slab with steel bar truss, composite slab with corrugated steel webs, pre-stressed hollow slab, etc. The bolts are pre-embedded on the side of the precast bottom slab, and the splicing of the precast bottom slab can be realized by using the cold-formed thin wall steel member. Mesh reinforcements are arranged on the precast bottom slabs which are spliced, and post-cast concrete is poured to make them into a whole as the prefabricated floor slab. In addition, due to the deformation of the replaceable coupling beam damper under strong earthquakes may lead to serious damage to the upper floor, isolation seams are set for the prefabricated floor slab above the replaceable coupling beam damper and can be filled with polyurethane foam.

The foundation includes the embedded components required for connecting with the shear wall, e.g., T-shaped steel beam of bottom connecting component, perforated end plates and bolts.

The construction procedure of the present disclosure includes the following steps:

Step 1: prefabricate the main components in a factory, which include precast wall panels, bottom connecting components, replaceable corner components, high-performance padding blocks, slotted steel plates, wall connectors, non-replaceable prefabricated coupling beams and replaceable coupling beam dampers. For the precast wall panel arranged at the bottom of the structure, the lower end of the longitudinal reinforcements in the wall panel is directly connected to the T-shaped steel beam of the bottom connecting component by welding;

Step 2: arrange the required embedded components, including T-shaped steel beam, perforated end plates and bolts, in foundation formwork, then pour the concrete to complete the foundation construction;

Step 3: fasten the replaceable corner components to the foundation and the bottom precast wall panel, and connect the energy-consuming connection steel plate to the upper and lower T-shaped steel beams through high-strength pins, then assemble high-performance padding blocks on the outside of the energy-consuming connection steel plate, and finally fasten slotted steel plates which arranged outside high-performance padding blocks to the foundation and the bottom connecting component to complete the construction of the bottom structure of the shear wall;

Step 4: assemble the wall connectors on the top of the precast wall panel and connect them by high-strength bolts, then assemble the upper precast wall panel on the top of the wall connectors with bolt connection, and assemble them sequentially from bottom to top;

Step 5: connect the stiffened box-shape connector with pre-embedded connector in the precast wall panel by high-strength bolts to make precast wall panel and non-replaceable prefabricated coupling beam as a whole;

Step 6: assemble the precast bottom slabs on the top of the precast wall panels and the non-replaceable prefabricated coupling beams, and use the cold-formed thin wall steel members to realize connection between floor slabs, then set the mesh reinforcements on the slabs and pouring post-cast concrete to complete the construction of the prefabricated floor slabs;

Step 7: assemble the replaceable coupling beam dampers between two non-replaceable prefabricated coupling beams by high-strength bolts, and the construction of the structure is finished.

The embodiments have the following advantages:

(1) All components, except post-cast concrete of the prefabricated floor slab, could be produced in a factory with a standardized process. All field connecting are completed with bolts or pins, the installation quality is controllable, and fully prefabricated construction of shear walls is realized. The embodiments greatly reduce the labor and time costs, improves the construction quality and speed, and meets the requirements of sustainable building advocated worldwide.

(2) The shear wall has good deformation capacity, self-centering capacity, and energy-dissipating capacity. The replaceable corner components not only have good mechanical properties, but also provide the restoring force to the shear wall to reduce the residual deformation after earthquakes. In addition, the replaceable coupling beam dampers and the slotted steel plates of the embodiments also dissipate seismic energy under earthquake action, which provides multiple protect lines for the structure.

(3) The shear wall has the characteristics of low damage and post-earthquake rapid recovery. The structural damage mainly concentrates on the replaceable corner components, the replaceable coupling beam dampers and the slotted steel plates, and the main structure remains elastic under earthquakes. The function of the shear wall structure could be quickly restored by replacing the replaceable components after earthquakes, which minimize the impact on normal life and production. Furthermore, the bottom of the shear wall consists of high-performance padding blocks, which can maintain high bearing capacity after cracking and be replaced through convenient construction process.

1, replaceable corner component; 2, bottom connecting component; 3, high-performance padding block; 4, slotted steel plate; 5, precast wall panel; 6, wall connector; 7, non-replaceable prefabricated coupling beam; 8, replaceable coupling beam damper; 9, prefabricated floor slab; 10, foundation; 11, outer steel tube; 12, inner steel tube; 13, infilled grout; 14, energy dissipation steel bar; 15, disc spring; 16, stop round steel plate; 17, perforated round steel plate; 18, connecting steel tube; 19, perforated end plate; 20, T-shaped steel beam; 21, energy-consuming connection steel plate; 22, high-strength pin; 23, high-strength bolt; 24, slotted steel plate; 25 horizontal connecting steel plate; 26, stiffener; 27, longitudinal reinforcement; 28, stirrup; 29, concrete; 30, bolt sleeve; 31, stud; 32, embedding steel plate; 33, steel web; 34, stiffened box-shape connector; 35, energy-dissipation damper; 36, precast bottom slab; 37, cold-formed thin wall steel member; 38, mesh reinforcement; 39, polyurethane foam.

DETAILED DESCRIPTION OF THE EMBODIMENTS

Figure 1:
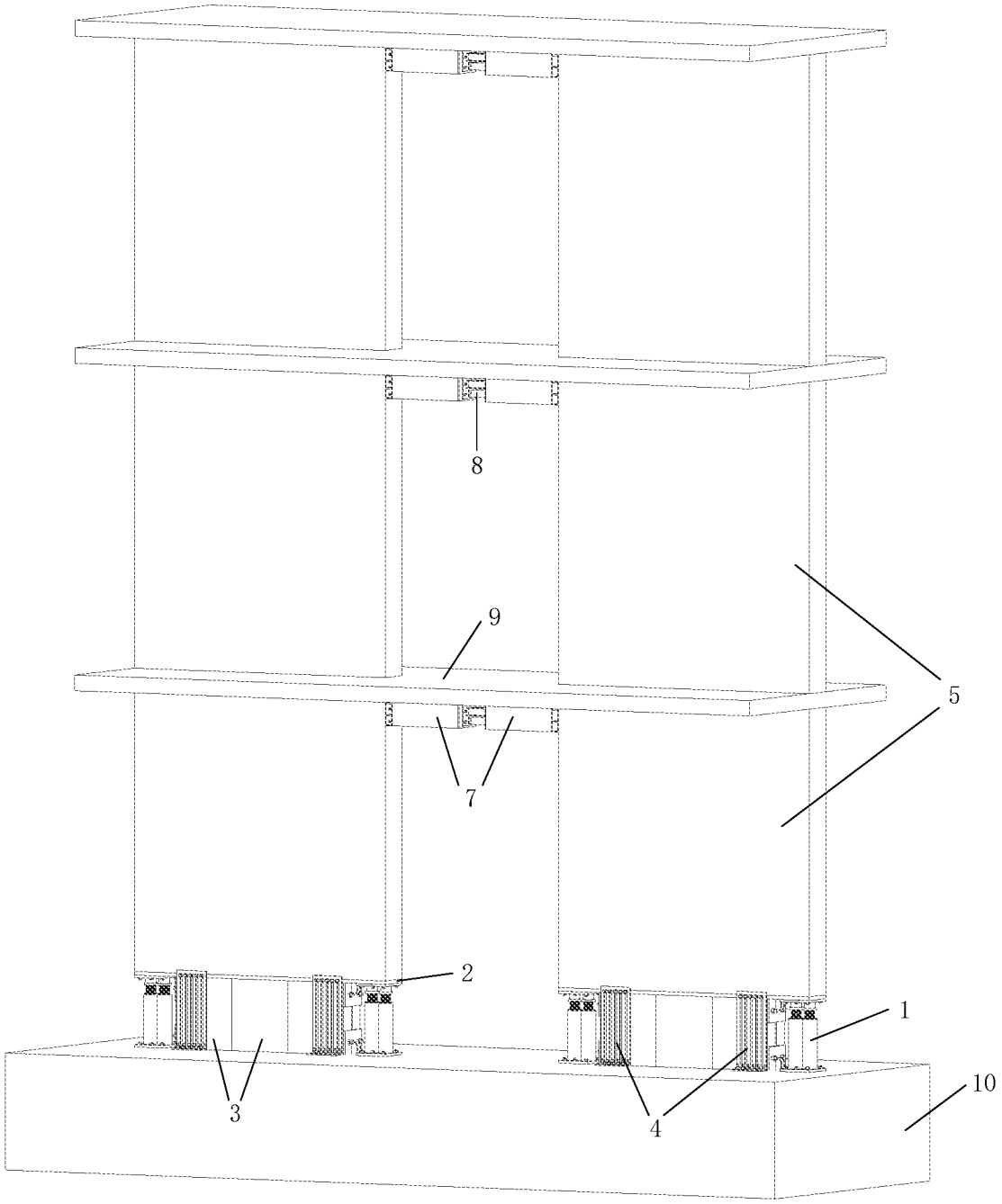
FIG. 1 is a general view of the function-recoverable prefabricated seismic shear wall structure.
Figure 2:
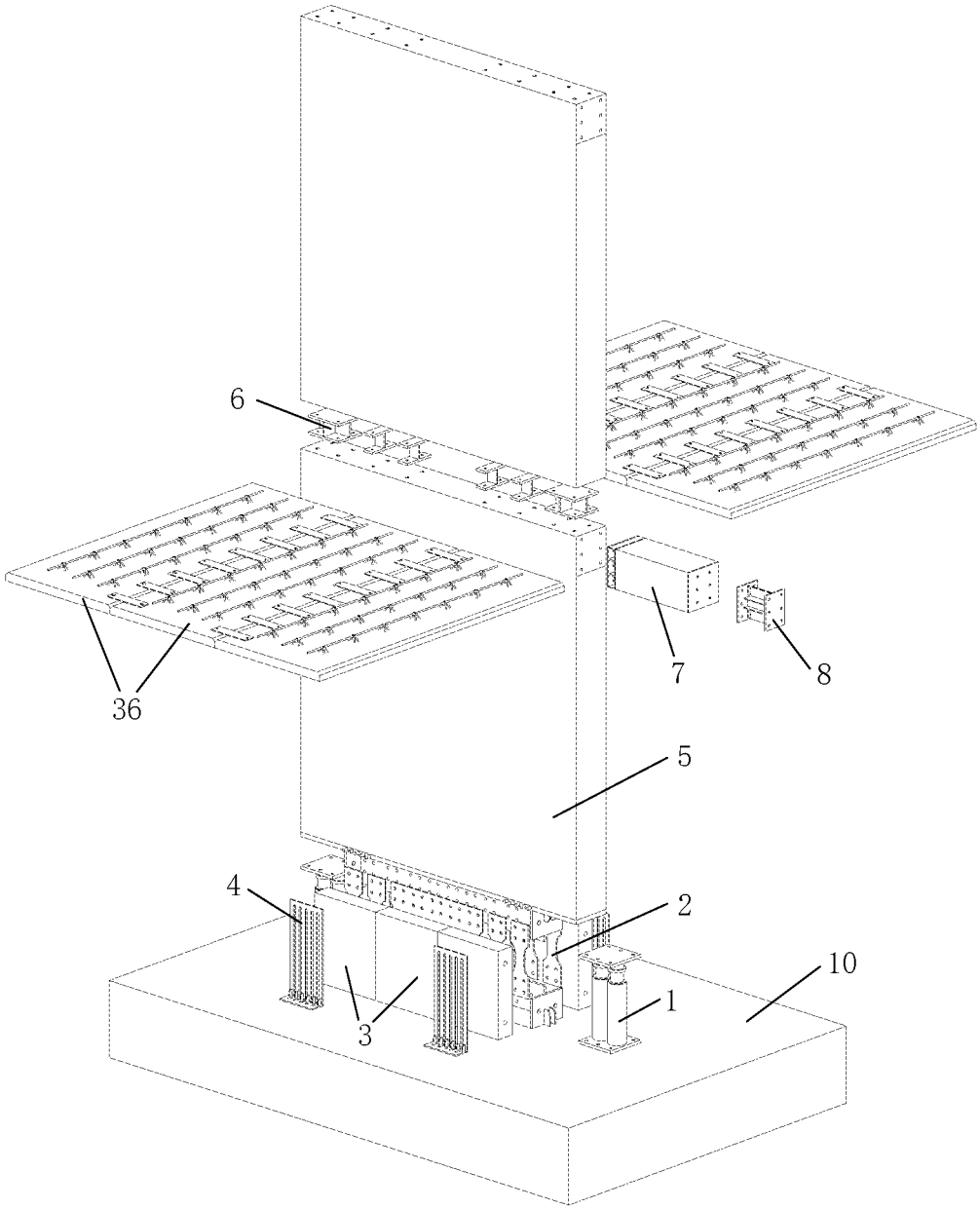
FIG. 2 is an assembly view of the function-recoverable prefabricated seismic shear wall structure.

The embodiments are further described below with the drawings:

As shown in FIG. 1 and FIG. 2, the function-recoverable prefabricated shear wall structure with replaceable components comprises of replaceable corner components 1, bottom connecting component 2, high-performance padding blocks 3, slotted steel plates 4, precast wall panels 5, wall connectors 6, non-replaceable prefabricated coupling beams 7, replaceable coupling beam dampers 8, prefabricated floor slabs 9 and foundation 10 assembly.

The bottom connecting component 2 locates in the bottom of the structure, it connects foundation 10 and the first layer precast wall panels 5. Replaceable corner components 1 and high-performance padding blocks 3 is disposed between the upper and lower T-shaped steel beam 20 while the replaceable corner components 1 are disposed at both ends and high-performance padding blocks 3 is disposed in the center. The two are connected by bolts and screws respectively.

The slotted steel plates 4 are disposed in both sides of the wall structure in thickness direction, and connect foundation 10 and bottom connecting component 2.

The wall connectors 6 connect upper and lower prefabricated wall 5 by bolt sleeves.

The prefabricated floor slabs 9 are disposed on both sides of the wall connector 6, the precast bottom slab 36 are disposed on top of the lower precast wall panel. Precast bottom slabs 36 are integrated by cold-formed thin wall steel member 37.

Non-replaceable prefabricated coupling beam 7 and replaceable coupling beam damper 8 are disposed between prefabricated walls 5 in horizontal, and below floor slab. The end of non-replaceable prefabricated coupling beam 7 with connect stiffened box-shape connector 34 connects with precast wall by high-strength bolts, the other end connects with replaceable coupling beam damper 8.

Figure 3:
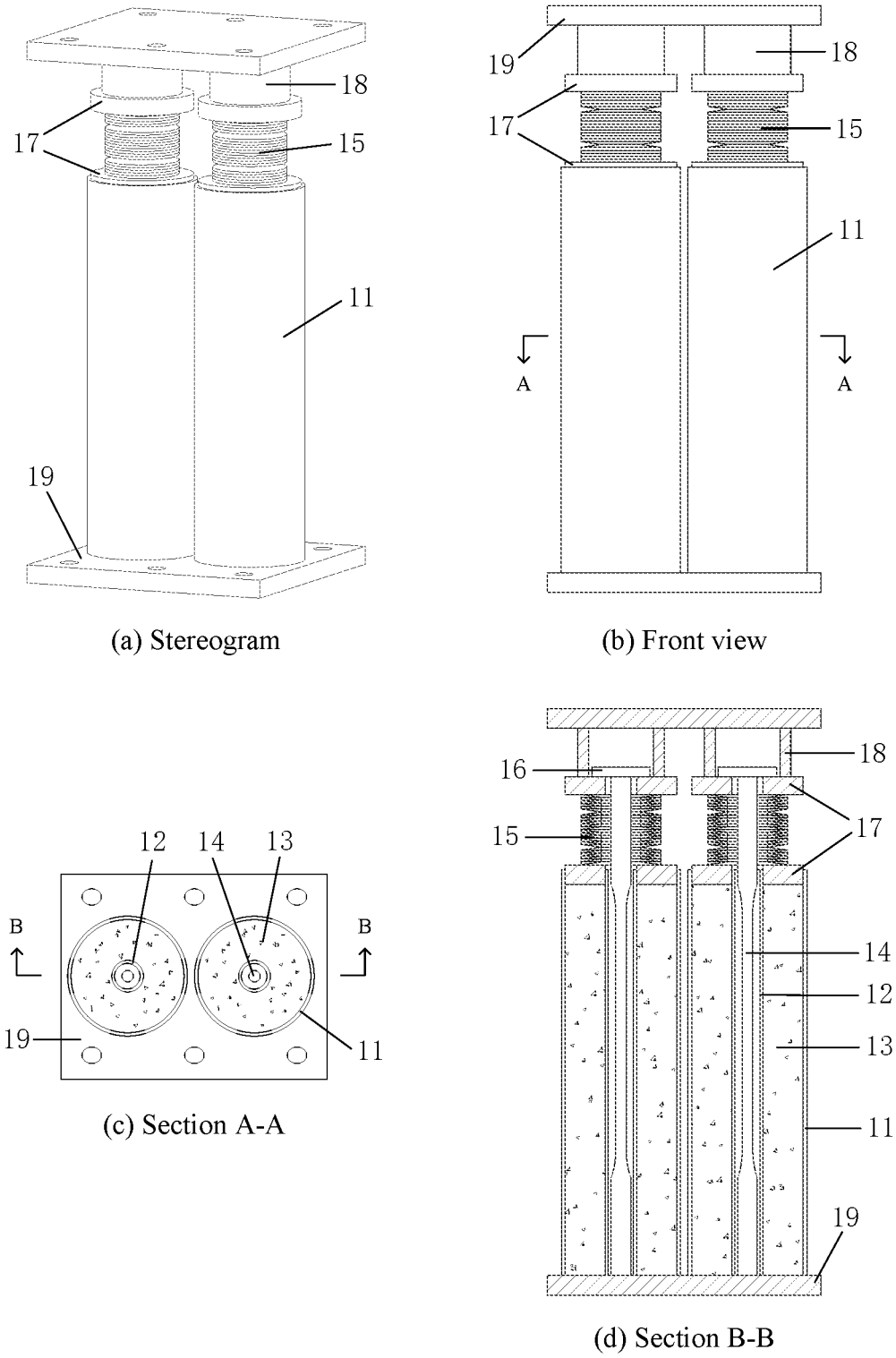
FIG. 3 is a structural view of the replaceable corner component.

As shown in FIG. 3, the replaceable corner component 1 is composed of outer steel tubes 11, inner steel tubes 12, infilled grout 13, energy dissipation steel bars 14, disc springs 15, stop round steel plates 16, perforated round steel plates 17, connecting steel tubes 18 and perforated end plates 19. The outer steel tubes 11 and inner steel tubes 12 are welded on the bottom perforated end plate 19, and the infilled grout 13 is filled between the outer and inner steel tube. Polytetrafluoroethylene material is coated on the inner wall of the outer steel tube 11 and the outer wall of the inner steel tube 12 to relieve the bonding between the steel tube and infilled grout 13. The outer diameter of the perforated round steel plates 17 equals to the inner diameter of the outer steel tube 11, and its opening-hole size equals to the outer diameter of the inner steel tube 12. The upper perforated round steel plate 17 is welded to the connecting steel tube 18 and the lower perforated round steel plate 17 is in contact with the top surface of the infilled grout 13. The disc springs 15 are installed between the upper and lower perforated round steel plates 17 and combined in series and parallel, the inner diameter of the disc springs 15 is slightly larger than the outer diameter of the end of the energy dissipation steel bar 14. The energy dissipation steel bar 14 is set inside the inner steel tube 12, and its ends are welded to the perforated end plate 19 and the stop round steel plate 16, respectively. The bottom of the stop round steel plate 16 is in contact with the top of the upper perforated round steel plate 17, and there is no connection between them, allowing for free separation. When the replaceable corner component 1 is compressed, the disc springs 15 are compressed along with the infilled grout 13, and energy dissipation steel bar 14 does not come into play due to separated gap between the stop round steel plate 16 and the upper perforated round steel plate 17. The disc springs 15 store the seismic energy through elastic deformation and convert the deformation energy into restoring force, which effectively reduces the residual deformation of the structure after the earthquake. When the replaceable corner component 1 is subjected to tension, the top device of the component is lifted, the upper perforated round steel plate 17 meets the stop round steel plate 16 and the energy dissipation steel bar 14 is stretched individually to dissipate seismic energy while the disc springs 15 and infilled grout 13 do not come into play. The replaceable corner component 1 has high bearing capacity, stiffness, energy-dissipating capacity and self-centering capacity, which can significantly improve the seismic behavior of the shear wall.

Figure 4:
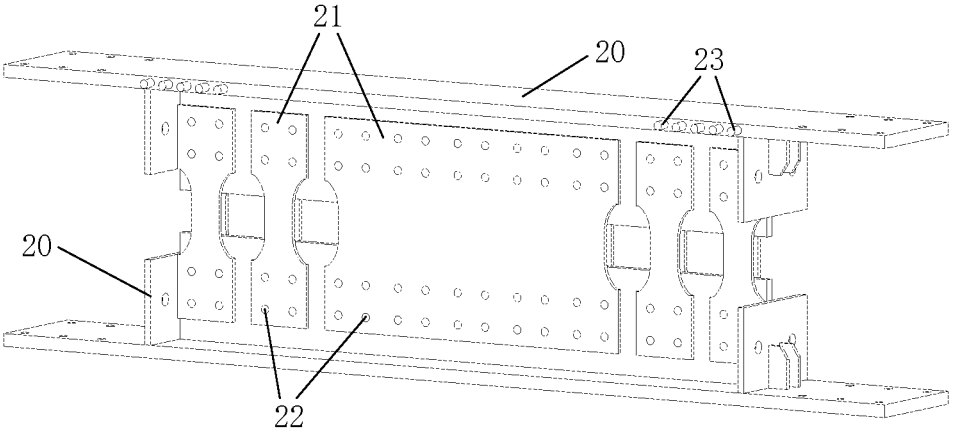
FIG. 4 is a structural view of the bottom connecting component.
Figure 4:
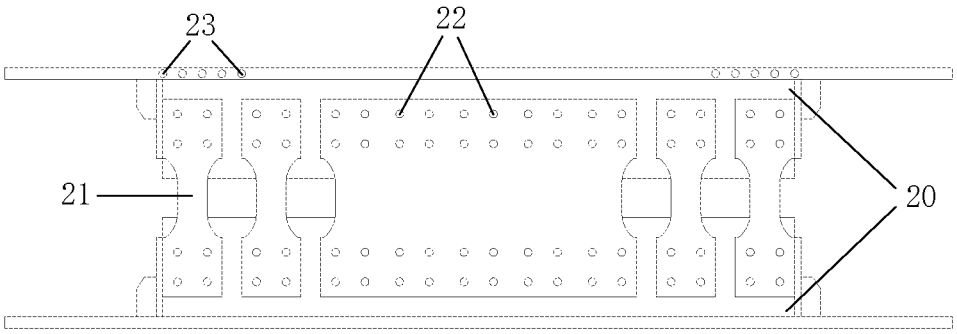
Figure 4:
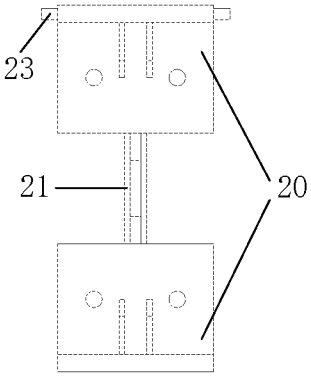

As shown in FIG. 4, the bottom connecting component 2 is composed of T-shaped steel beams 20, energy-consuming connection steel plate 21, high-strength pins 22 and high-strength bolts 23. Each bottom connecting component 2 includes two T-shaped steel beams 20, the upper one is connected to the bottom of the precast wall panel 5 and the lower one is embedded in the foundation 10.

The T-shaped steel beams 20 is welded by a rectangular long steel plate, a perforated steel plate and a stop steel plate. The rectangular long steel plate is a flange, the perforated steel plate is a web, and the stop steel sheet is disposed on both sides of the web and the wing.

The length and width of the flange of the T-shaped steel beam 20 are consistent with the section dimensions of the precast wall panel 5, and the end of the flange is provided with threaded holes and high-strength bolts 23 for connecting with the replaceable corner component 1 and slotted steel plate 4 respectively. The web of the T-shaped steel beam 20 is provided with holes and the length is less than that of the flange, which is about 0.6 to 0.8 times the length of the wall panel 5. The stiffened plates are welded to both ends of the web to connect the high-performance padding block 3. The end of the energy-consuming connection steel plate 21 is provided with holes, which can be connected to the upper and lower T-shaped steel beams 20 by high-strength pins 22. The energy-consuming connection steel plate 21 can provide bending and shear bearing capacity for the shear wall, and the specific size and quantity can be designed according to engineering requirements.

The high-performance padding block 3 can be made of ultra-high toughness cementitious composites (UHTCC) concrete material. The block has two full-length holes along the length direction and is connected to T-shaped steel beams 20 by screws. Compared with conventional concrete blocks of the same strength, the high-performance padding block is characterized by high toughness and ductile failure mode, and can still maintain high bearing capacity even after cracking. The high-performance padding block is suitable for the bottom part of the shear wall which is prone to cracking and collapse under the earthquake. Furthermore, the damaged high-performance padding block can be replaced after a strong earthquake.

Figure 6:
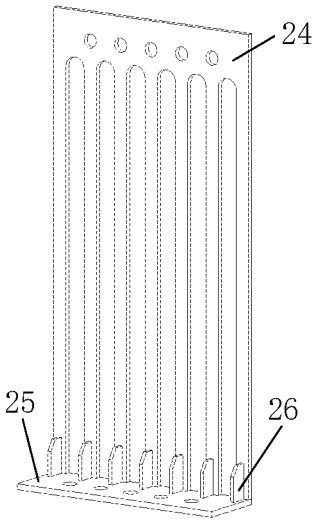
FIG. 6 is a structural view of the slotted steel plate.

As shown in FIG. 6, the slotted steel plate 4 is composed of slotted steel plate 24, horizontal connecting steel plate 25 and stiffener 26, which are welded into a whole. On each side of the wall base, two slotted steel plates 4 are fastened to the foundation 10 and a T-shaped steel beam 20 by embedded high-strength bolts 23. On one hand, the installation of slotted steel plate can compensate for the reduced lateral stiffness of the structure due to the setting of replaceable corner component. On the other hand, the vertical strips of the slotted steel plate dissipate the seismic energy through plastic deformation under earthquakes to reduce the damage to the main structure. Furthermore, the damaged slotted steel plates can be replaced after the strong earthquake.

Figure 5:
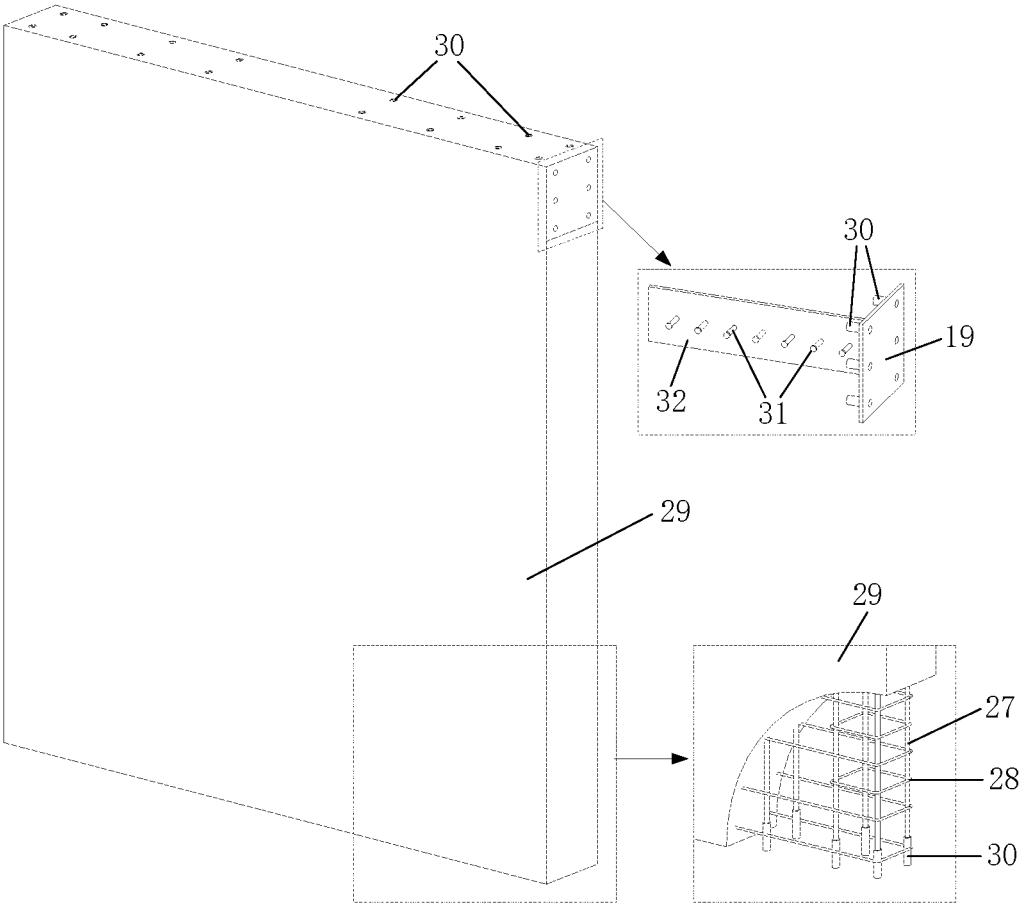
FIG. 5 is a structural view of the precast wall panel.

As shown in FIG. 5, the precast wall panel 5 is composed of longitudinal reinforcements 27, stirrups 28, concrete 29, perforated end plate 19, bolt sleeves 30, studs 31 and embedding steel plate 32. The bolt sleeves 30 are embedded in the wall panel and welded to the end of the longitudinal reinforcements 27. The bolt sleeves 30 can be connected to the wall connector 6 by bolts to form the bolt-wall connector-bolt sleeve connection system, and then achieve the connection of upper and lower precast wall panels 5. For the precast wall panel 5 arranged at the bottom of the structure, the lower end of the longitudinal reinforcements 27 in the wall panel do not need to be set with bolt sleeves, and is welded directly to the T-shaped steel beam 20 of the bottom connecting component 2 in factory production. For the precast wall panel 5 that needs to be connected to the non-replaceable prefabricated coupling beam 7, a connector is pre-embedded at the top of the wall panel, which includes perforated end plate 19, bolt sleeves 30, studs 31 and embedding steel plate 32.

Figure 7:
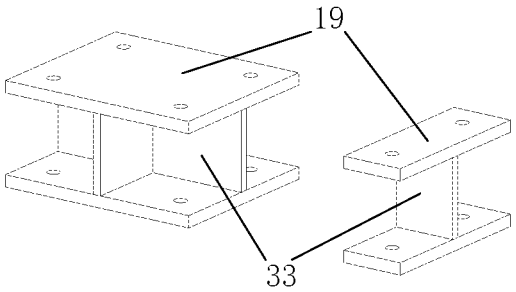
FIG. 7 is a structural view of the wall connector.

As shown in FIG. 7, the wall connector 6 is composed of a steel web 33 and two perforated end plates 19. The steel web 33 can be in the form of cross-shaped or rectangle steel plate, which is welded to the perforated end plates 19. The perforated end plate 19 is provided with threaded holes for bolting to the bolt sleeves 30 in the precast wall panel 5.

Figure 8:
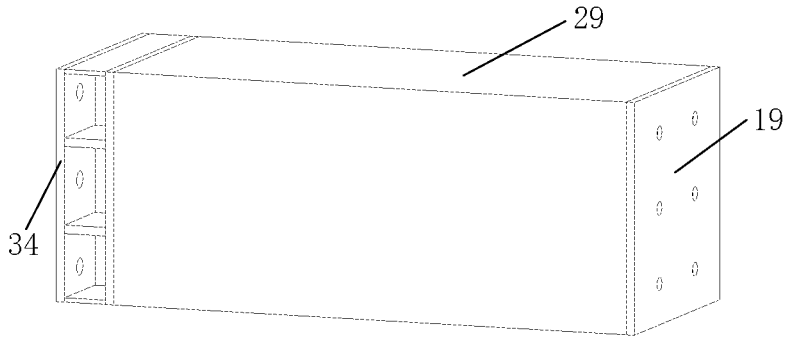
FIG. 8 is a structural view of the non-replaceable prefabricated coupling beam.
Figure 8:
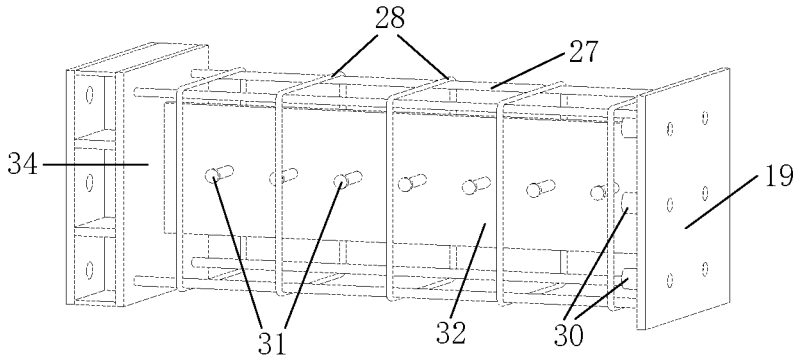

As shown in FIG. 8, the non-replaceable prefabricated coupling beam 7 is composed of longitudinal reinforcements 27, stirrups 28, concrete 29, perforated end plate 19, bolt sleeves 30, studs 31, embedding steel plate 32 and stiffened box-shape connector 34. The longitudinal reinforcements 27 and embedding steel plate 32 are arranged between perforated end plate 19 and stiffened box-shape connector 34, and studs 31 are assigned on the embedding steel plate 32 to improve the bonding between steel plate and concrete. The bolt sleeves 30 are welded to the perforated end plate 19, and the welding position is consistent with the position of the bolt holes on the perforated end plate 19 for connection to the replaceable coupling beam damper 8. The stiffened box-shape connector 34 is made of steel plates and stiffening rib plates, one side of the connector is welded to longitudinal reinforcements 27 and embedding steel plate 32, and the other side is connected to the embedded connector in the precast wall panel 5.

Figure 9:
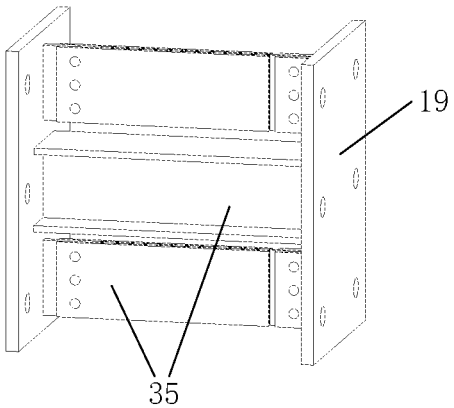
FIG. 9 is a structural view of the replaceable coupling beam damper.

As shown in FIG. 9, the replaceable coupling beam damper 8 is composed of energy-dissipation dampers 35 and two perforated end plates 19. The energy-dissipation damper 35 can be in various forms such as metal damper, viscoelastic damper, friction damper or hybrid damper. The energy-dissipation dampers are in central. The perforated end plates 19 are welded to both ends of the energy-dissipation dampers 35. The replaceable coupling beam damper 8 are bolted to the non-replaceable prefabricated coupling beam 7.

Figure 10:
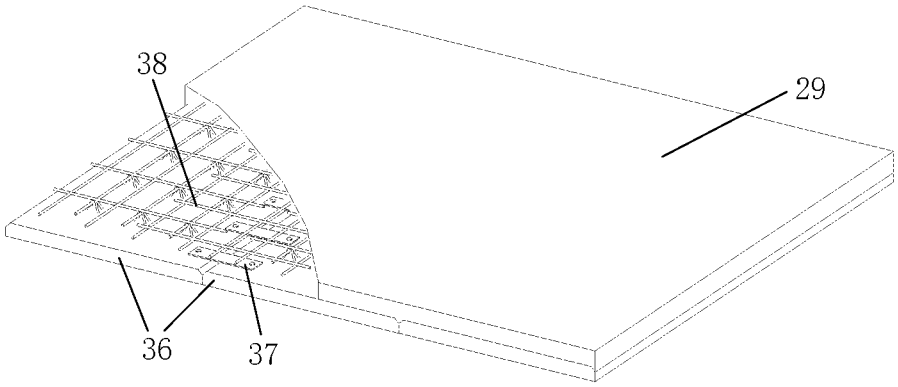
FIG. 10 is an assembly schematic diagram of the prefabricated floor slab.
Figure 10:
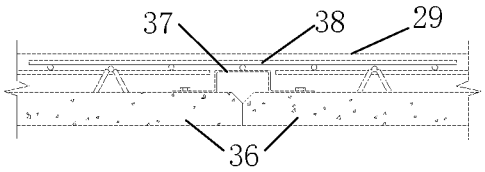
Figure 10:
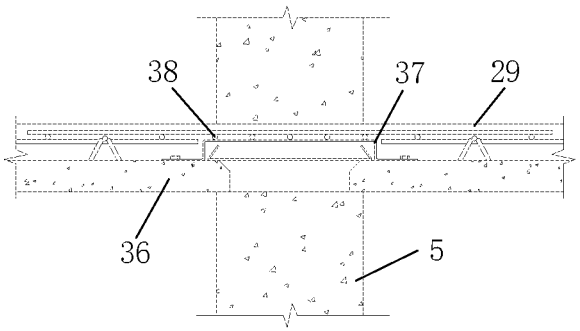
Figure 10:
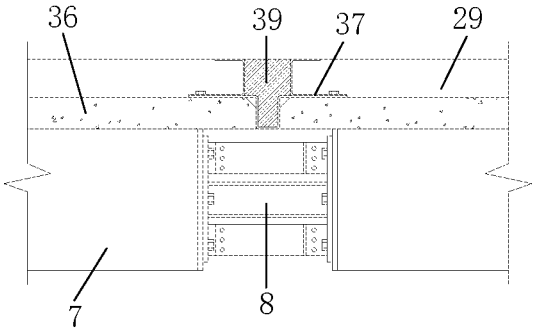

As shown in FIG. 10, the prefabricated floor slab 9 is composed of precast bottom slab 36, cold-formed thin wall steel member 37, mesh reinforcement 38 and post-cast concrete 29. The precast bottom slab 36 can be composite slab with steel bar truss, composite slab with corrugated steel webs, pre-stressed hollow slab, etc. The bolts 23 are pre-embedded on the side of the precast bottom slab 36, and the splicing of the precast bottom slab can be realized by using the cold-formed thin wall steel member 37. Mesh reinforcements 38 are arranged on the precast bottom slabs 36 which are spliced, and post-cast concrete 29 is poured to make them into a whole as the prefabricated floor slab 9. In addition, due to the deformation of the replaceable coupling beam damper under strong earthquakes may lead to serious damage to the upper floor, isolation seams are set for the prefabricated floor slab 9 above the replaceable coupling beam damper 8 and can be filled with polyurethane foam 39.

The foundation 10 includes the embedded components required for connecting with the shear wall, including a T-shaped steel beam 20 of bottom connecting component 2, perforated end plates 19 and bolts 23.

The construction procedure of the present disclosure includes the following steps:

Step 1: prefabricate the main components in a factory, which include precast wall panels 5, bottom connecting components 2, replaceable corner components 1, high-performance padding blocks 3, slotted steel plates 4, wall connectors 6, non-replaceable prefabricated coupling beams 7 and replaceable coupling beam dampers 8. For the precast wall panel 5 arranged at the bottom of the structure, the lower end of the longitudinal reinforcements 27 in the wall panel 5 is directly connected to the T-shaped steel beam 20 of the bottom connecting component 2 by welding;

Step 2: arrange the required embedded components, including T-shaped steel beam 20, perforated end plates 19 and bolts 23, in foundation formwork, then pour the concrete to complete the foundation construction;

Step 3: fasten the replaceable corner components 1 to the foundation and the bottom precast wall panel 5, and connect the energy-consuming connection steel plate 21 to the upper and lower T-shaped steel beams 20 through high-strength pins 22, then assemble high-performance padding blocks 3 on the outside of the energy-consuming connection steel plate 21, and finally fasten slotted steel plates 4 which arranged outside high-performance padding blocks 3 to the foundation 10 and the bottom connecting component 2 to complete the construction of the bottom structure of the shear wall;

Step 4: assemble the wall connectors 6 on the top of the precast wall panel 5 and connect them by high-strength bolts 23, then assemble the upper precast wall panel 5 on the top of the wall connectors 6 with bolt connection, and assemble them sequentially from bottom to top;

Step 5: connect stiffened box-shape connector 34 with pre-embedded connector in the precast wall panel 5 by high-strength bolts 23 to make precast wall panel 5 and non-replaceable prefabricated coupling beam 7 as a whole;

Step 6: assemble the precast bottom slabs 36 on the top of the precast wall panels 5 and the non-replaceable prefabricated coupling beams 7, and use the cold-formed thin wall steel members 37 to connect between floor slabs, then set the mesh reinforcements 38 on the slabs and pouring post-cast concrete 29 to complete the construction of the prefabricated floor slabs 9;

Step 7: assemble the replaceable coupling beam dampers 8 between two non-replaceable prefabricated coupling beams 7 by high-strength bolts 23, and the construction of the structure is finished, as shown in FIG. 1.

What is claimed is:

1. A function-recoverable prefabricated seismic shear wall structure, which comprises: replaceable corner components, bottom connecting component, high-performance padding blocks, slotted steel plates, precast wall panel, wall connector, non-replaceable prefabricated coupling beam, replaceable coupling beam damper, prefabricated floor slab and foundation;

wherein, the bottom connecting component located in the bottom of the shear wall structure, the bottom connecting component connects the foundation and the precast wall panel; the bottom connecting component comprises T-shaped steel beams, energy-consuming connection steel plates, high-strength pins, and high-strength bolts; the T-shaped steel beams comprises upper T-shaped steel beam and lower T-shaped steel beam, the upper T-shaped steel beam connects to the bottom of the precast wall panel and the lower T-shaped steel beam is embedded in the foundation;

the replaceable corner components and the high-performance padding blocks are disposed between the upper T-shaped steel beam and the lower T-shaped steel beam while the replaceable corner components are disposed at opposing ends of the shear wall structure and the high-performance padding blocks are disposed between the replaceable corner components;

the slotted steel plates are disposed at opposing sides of the shear wall structure in a thickness direction, and connect the foundation and the bottom connecting component;

the wall connector connects the precast wall panel at a lower floor and a second precast wall panel at an upper floor by bolt sleeves;

the prefabricated floor slabs is disposed on a side of the wall connector in horizontal;

the non-replaceable prefabricated coupling beam and the replaceable coupling beam damper are disposed between the precast wall panel and another precast wall panel in horizontal, and below the prefabricated floor slab; one end of the non-replaceable prefabricated coupling beam connects with the precast wall panel by high-strength bolts, the other end connects with the replaceable coupling beam damper;

the bottom connecting component, the high-performance padding blocks and the slotted steel plates are disposed in a foot of the shear wall structure, wherein, the energy-consuming connection steel plates are disposed in the bottom connecting component to provide anti-pull and anti-shear capacity, the high-performance padding blocks provide anti-compression and anti-shear capacity, and the slotted steel plates provide anti-shear capacity;

the shear wall structure can effectively ensure that the lateral stiffness and strength of the shear wall structure, and when the bottom of the shear wall structure is damaged under an earthquake, the energy-consuming connection steel plates, the high-performance padding blocks, and the slotted steel plates can be replaced so that the shear wall structure can be restored to the original functional level after the earthquake;

the shear wall structure has multiple seismic mechanisms:

a first one of the seismic mechanisms is the replaceable coupling beam damper;

a second one of the seismic mechanisms is the replaceable corner components;

a third one of the seismic mechanisms is the bottom connecting component, the high-performance padding blocks, and the slotted steel plates;

a fourth one of the seismic mechanisms is the non-replaceable prefabricated coupling beam.

2. The shear wall structure of claim 1, wherein each replaceable corner component comprises outer steel tubes, inner steel tubes, infilled grout, energy dissipation steel bar, disc springs, stop round steel plate, perforated round steel plates, connecting steel tubes and perforated end plates;

the perforated end plates comprises a top perforated end plate and a bottom perforated end plate;

the outer steel tubes and the inner steel tubes are respectively welded on the bottom perforated end plate, and the infilled grout is filled between the outer and inner steel tubes, the inner wall of the outer steel tubes and the outer wall of the inner steel tubes are coated with polytetrafluoroethylene material to relieve the bonding between the inner and outer steel tubes and the infilled grout;

the perforated round steel plates are provided with holes, the outer diameter of the perforated round steel plates equals to the inner diameter of the outer steel tubes, and hole diameter of the perforated round steel plates equals the outer diameter of the inner steel tubes; the perforated round steel plates comprise an upper perforated round steel plate and a lower perforated round steel plate, the lower perforated round steel plate is in contact with the top surface of the infilled grout and the upper perforated round steel plate is welded to the bottom of one of the connecting steel tubes, the top of each connecting steel tube is welded to the top perforated end plate;

the disc springs are installed between the upper perforated round steel plate and the lower perforated round steel plate and combined in series and parallel, the inner diameter of the disc springs is larger than the outer diameter of the energy dissipation steel bar;

the energy dissipation steel bar is set inside each inner steel tube, one end of the energy dissipation steel bar is welded to the bottom perforated end plate and the other end of it is welded to the stop round steel plate, the bottom of the stop round steel plate is in contact with the top of the upper perforated round steel plate;

when each replaceable corner component is compressed, the disc springs are compressed along with the infilled grout, and the energy dissipation steel bar does not work due to separated gap between the stop round steel plate and the upper perforated round steel plate; the disc springs store the seismic energy through elastic deformation and convert the deformation energy into restoring force, which effectively reduces the residual deformation of the shear wall structure after an earthquake;

when the replaceable corner components are subjected to tension, an upper part of each replaceable corner component is lifted, the upper perforated round steel plate meets the stop round steel plate and the energy dissipation steel bar is stretched individually to dissipate seismic energy while the disc springs and the infilled grout do not come into play.

3. The shear wall structure of claim 1, wherein the T-shaped steel beams are formed by welding a rectangular long steel plate, a perforated steel plate and stop steel plates;

the perforated steel plate is vertical to the rectangular long steel plate, the stop steel plates are disposed on opposing sides of the perforated steel plate;

the length and width of the rectangular long steel plate is consistent with the section dimensions of the precast wall panel, threaded holes are provided at opposing ends of the rectangular long steel plate in length direction for connecting an end plate of one of the replaceable corner components, the length of the perforated steel plate is less than the rectangular long steel plate, each stop steel plate is a steel sheet with stiffeners, the stop steel plates are welded to opposing ends of the perforated steel plate and connect one of the high-performance padding blocks;

furthermore, on the T-shaped steel beams which are connected to an upper wall, the high-strength bolts are welded to opposing sides of flange of the T-shaped steel beams to connect with the slotted steel plates; each one of the energy-consuming connection steel plates is a steel plate with I-shaped cross-section; the upper and lower ends of the energy-consuming connection steel plates are provided with holes, which are connected to the upper and lower T-shaped steel beams by the high-strength pins;

the energy-consuming connection steel plates are arranged on opposing sides of the perforated steel plate.

4. The shear wall structure of claim 1, wherein each high-performance padding block has two full-length holes along the length direction and is connected to the T-shaped steel beams by screws.

5. The shear wall structure of claim 1, wherein the slotted steel plates comprise a slotted stressed steel plate, a horizontal connecting steel plate and stiffeners, which are welded into a whole, on opposing sides of the base of the shear wall structure, the slotted steel plates are fastened to the foundation and the T-shaped steel beams by the high-strength bolts.

6. The shear wall structure of claim 1, wherein the precast wall panel is composed of longitudinal reinforcements, stirrups, concrete, perforated end plate, the bolt sleeves, embedding steel plate and studs; the bolt sleeves are embedded in the precast wall panel and welded to an end of the longitudinal reinforcements; the bolt sleeves are connected to the wall connector by bolts;

for the precast wall panel arranged at the bottom of the shear wall structure, the lower end of the longitudinal reinforcements in the precast wall panel is welded directly to the T-shaped steel beams of the bottom connecting component in factory production.

7. The shear wall structure of claim 1, wherein the wall connector is composed of a steel web and two perforated end plates, the steel web is in the form of a cross-shaped or I-shaped steel plate, which is welded to the perforated end plates in opposing sides, the perforated end plates are provided with threaded holes for bolting to the bolt sleeves in the precast wall panel.

8. The shear wall structure of claim 1, wherein the non-replaceable prefabricated coupling beam is composed of longitudinal reinforcements, stirrups, concrete, perforated end plate, bolt sleeves, studs, embedding steel plate and stiffened box-shape connector, the longitudinal reinforcements and embedding steel plate are arranged between the perforated end plate and the stiffened box-shape connector, and the studs are assigned on the embedding steel plate to improve the bonding between the embedding steel plate and the concrete, the bolt sleeves are welded to the perforated end plate, and welding position is consistent with the position of bolt holes on the perforated end plate for connection to the replaceable coupling beam damper; the stiffened box-shape connector is made of steel plates and stiffening rib plates, one side of the stiffened box-shape connector is welded to the longitudinal reinforcements and the embedding steel plate, and the other side is connected to the embedded connector in the precast wall panel.

9. The shear wall structure of claim 1, wherein the replaceable coupling beam damper comprises energy-dissipation dampers and two perforated end plates;

the energy-dissipation dampers are in the center of the perforated end plates and the perforated end plates are welded to opposing ends of the energy-dissipation dampers, and are bolted to the non-replaceable prefabricated coupling beam.

10. The shear wall structure of claim 1, wherein the prefabricated floor slab is composed of precast bottom slabs, bolts, cold-formed thin wall steel member, mesh reinforcement and post-cast concrete; the bolts are pre-embedded on a side of the precast bottom slabs, and a splicing of the precast bottom slabs is realized by using the cold-formed thin wall steel member; the mesh reinforcement is arranged on the precast bottom slabs which are spliced, and post-cast concrete is poured to make them into a whole as the prefabricated floor slab.

* * * * *